US009163875B2

(12) United States Patent
Bucks et al.

(10) Patent No.: US 9,163,875 B2
(45) **Date of Patent: *Oct. 20, 2015**

(54) ACOUSTIC DRYING SYSTEM WITH SOUND OUTLET CHANNEL

(71) Applicant: Eastman Kodak Company, Rochester, NY (US)

(72) Inventors: Rodney Ray Bucks, Webster, NY (US); Michael Alan Marcus, Honeoye Falls, NY (US); Kam Chuen Ng, Rochester, NY (US); Andrew Ciaschi, Brockport, NY (US)

(73) Assignee: EASTMAN KODAK COMPANY, Rochester, NY (US)

( * ) Notice: Subject to any disclaimer, the term of this patent is extended or adjusted under 35 U.S.C. 154(b) by 386 days.

This patent is subject to a terminal disclaimer.

(21) Appl. No.: 13/744,776

(22) Filed: Jan. 18, 2013

(65) Prior Publication Data

US 2014/0202022 A1 Jul. 24, 2014

(51) Int. Cl.

| | |
|---|---|
| ***F26B 7/00*** | (2006.01) |
| ***B41M 7/00*** | (2006.01) |
| ***B41F 23/04*** | (2006.01) |
| ***B41J 11/00*** | (2006.01) |
| ***F26B 5/02*** | (2006.01) |

(52) U.S. Cl.

CPC ..... *F26B 7/00* (2013.01); *B41F 23/0436* (2013.01); *B41J 11/002* (2013.01); *B41M 7/0072* (2013.01); *F26B 5/02* (2013.01)

(58) Field of Classification Search

CPC ..... F26B 5/02; F26B 7/00; B41J 11/0015; B41J 11/002; B41M 7/0072; B41F 23/0426

See application file for complete search history.

(56) References Cited

U.S. PATENT DOCUMENTS

| | | | | |
|---|---|---|---|---|
| 3,694,926 | A | 10/1972 | Rodwin et al. | |
| 3,750,306 | A | 8/1973 | Rodwin et al. | |
| 6,393,719 | B1 | 5/2002 | Stipp | |
| 6,431,702 | B2 | 8/2002 | Ruhe | |
| 6,754,457 | B2 | 6/2004 | Ciaschi et al. | |
| 2010/0199510 | A1 | 8/2010 | Plavnik | |
| 2014/0202023 | A1 * | 7/2014 | Bucks et al. | 34/279 |

FOREIGN PATENT DOCUMENTS

| | | |
|---|---|---|
| JP | 07-055338 | 3/1995 |

OTHER PUBLICATIONS

Gene, Plavnik, "Innovative drying technology can improve productivity," GravurEzine, pp. 8-12, http://www.gravurexchange.com/articles/heat-technologies.htm, Apr. 2011.

* cited by examiner

*Primary Examiner* — Jiping Lu
(74) *Attorney, Agent, or Firm* — Kevin E. Spaulding

(57) ABSTRACT

An acoustic wave drying system for drying a material using an acoustic resonant chamber that imparts acoustic energy to transiting air received from an airflow source. The acoustic resonant chamber includes a primary air channel having side surfaces connecting an air inlet and an air outlet, the primary air channel having a primary air channel length between the air inlet and the air outlet. A closed-end resonant chamber is formed into a first side surface of the primary air channel, the closed-end resonant chamber having a resonant chamber length. The acoustic resonant chamber also includes a sound air channel having a sound air channel inlet on a second side surface of the primary air channel opposite to the closed-end resonant chamber and a sound air channel outlet for directing an air impingement airstream containing acoustic energy onto the material.

13 Claims, 7 Drawing Sheets

ACOUSTIC DRYING SYSTEM WITH SOUND OUTLET CHANNEL

CROSS-REFERENCE TO RELATED APPLICATIONS

Reference is made to commonly assigned, co-pending U.S. patent application Ser. No. 13/693,309, entitled: "Acoustic drying system with matched exhaust flow", by Shifley et al.; and to commonly assigned, co-pending U.S. patent application Ser. No. 13/693,336, entitled: "Acoustic drying system with peripheral exhaust conduits", by Bucks et al.; to commonly assigned, co-pending U.S. patent application Ser. No. 13/744,751, entitled: "Acoustic wave drying system", by Bucks et al.; to commonly assigned, co-pending U.S. patent application Ser. No. 13/744,837, entitled: "Acoustic wave drying method", by Bucks et al.; and to commonly assigned, co-pending U.S. patent application Ser. No. 13/744,776, entitled: "Acoustic drying method using sound outlet channel", by Bucks et al., each of which is incorporated herein by reference.

FIELD OF THE INVENTION

The present invention relates to the drying of a medium which has received a coating of a liquid material, and more particularly to the use of an air impingement stream and acoustic energy to dry the volatile components of the coating.

BACKGROUND OF THE INVENTION

There are many examples of processes where liquid coatings are applied to the surface of a medium, and where it is necessary to remove a volatile portion of the liquid coating by some drying process. The image-wise application of aqueous inks in a high speed inkjet printer to generate printed product, and the subsequent removal of water from the image-wise ink deposit, is one example of such a process. Web coating of either aqueous or organic solvent based materials in the production of photographic films or thermal imaging donor material and the removal of water or solvent from the coated web is another example. The drying process often involves the application of heat and an airstream to evaporate the volatile portion of the liquid coating and remove the vapor from proximity to the medium. The application of heat and the removal of the volatile component vapor both accelerate the evaporation process.

In pneumatic acoustic generator air impingement drying systems, there are generally three components that are used to accelerate the drying process. Heated air is supplied through a slot in the dryer so that it impinges on the coated medium. This heated air supplies two of the components that accelerate drying: heat and an airstream. A third component that is used to accelerate the evaporation of volatile component of the liquid coating is the acoustic energy. The pneumatic acoustic generator is designed such that it generates acoustic waves (i.e., sound) at high sound pressure levels and at fixed frequencies as the impinging air stream passes through the main air channel of the pneumatic acoustic generator. The output of the pneumatic acoustic generator is an airstream that contains high levels of sound energy. The pressure fluctuations associated with the sound energy will disrupt the boundary layer that forms at the interface between the liquid coating and the air; this allows an accelerated transport of both heat and vapor at the liquid to gas boundary. In the absence of the pressure fluctuations associated with the sound energy, the transport of vapor across the boundary layer would rely on diffusion.

To be effective as a drying system, the pneumatic acoustic generator needs to produce high sound pressure levels without requiring excessive airstream velocity in the main air channel. High sound pressure levels are necessary to accelerate the drying process, but the high airstream velocities that are normally associated with such high sound pressure levels can disrupt the liquid coating and cause undesirable image artifacts or coating defects. There remains a need for a high efficiency pneumatic acoustic generator where the ratio of the sound pressure level to the impingement air velocity is high in the air impingement drying zone.

SUMMARY OF THE INVENTION

The present invention represents an acoustic wave drying system for drying a material, comprising:

- an airflow source;
- an acoustic resonant chamber that directs acoustic energy onto the material, including:
  - an air inlet for receiving air from the airflow source;
  - an air outlet;
  - a primary air channel having side surfaces connecting the air inlet and the air outlet, the primary air channel having a primary air channel length between the air inlet and the air outlet;
  - a closed-end resonant chamber formed into a first side surface of the primary air channel, the closed-end resonant chamber having side surfaces and a resonant chamber length; and
  - a sound air channel having a sound air channel inlet on a second side surface of the primary air channel opposite to the closed-end resonant chamber and a sound air channel outlet for directing an air impingement airstream containing acoustic energy onto the material, the material being spaced apart from the sound air channel outlet by a gap distance, the sound air channel having a sound air channel length between the sound air channel inlet and the sound air channel outlet;
- wherein a first fraction of the air received from the airflow source is directed out of the pneumatic transducer through the air outlet and a second fraction of the air received from the airflow source is directed out of the pneumatic transducer through the sound air channel outlet as the air impingement airstream.

This invention has the advantage that drying is accelerated by a combination of heat and air flow, together with the disruption of the boundary layer using acoustic energy, such that drying can be accomplished in a small area and the dryer can be a compact device.

It has the additional advantage that the acoustic wave drying system creates high sound pressure levels that accelerate drying while the exit air flow velocity is low enough that the liquid coating is not disrupted by the air flow.

It has the further advantage that only a fraction of the air flow used to generate the sound waves in the resonant cavity is directed into the impingement air stream, so that higher sound pressure levels can be achieved while limiting the exit velocity of the impingement airstream.

It is to be understood that the attached drawings are for purposes of illustrating the concepts of the invention and may not be to scale.

DETAILED DESCRIPTION OF THE INVENTION

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. It should be noted that, unless otherwise explicitly noted or required by context, the word "or" is used in this disclosure in a non-exclusive sense.

The present invention will be directed in particular to elements forming part of, or in cooperation more directly with the apparatus in accordance with the present invention. It is to be understood that elements not specifically shown or described may take various forms well known to those skilled in the art.

Figure 1:
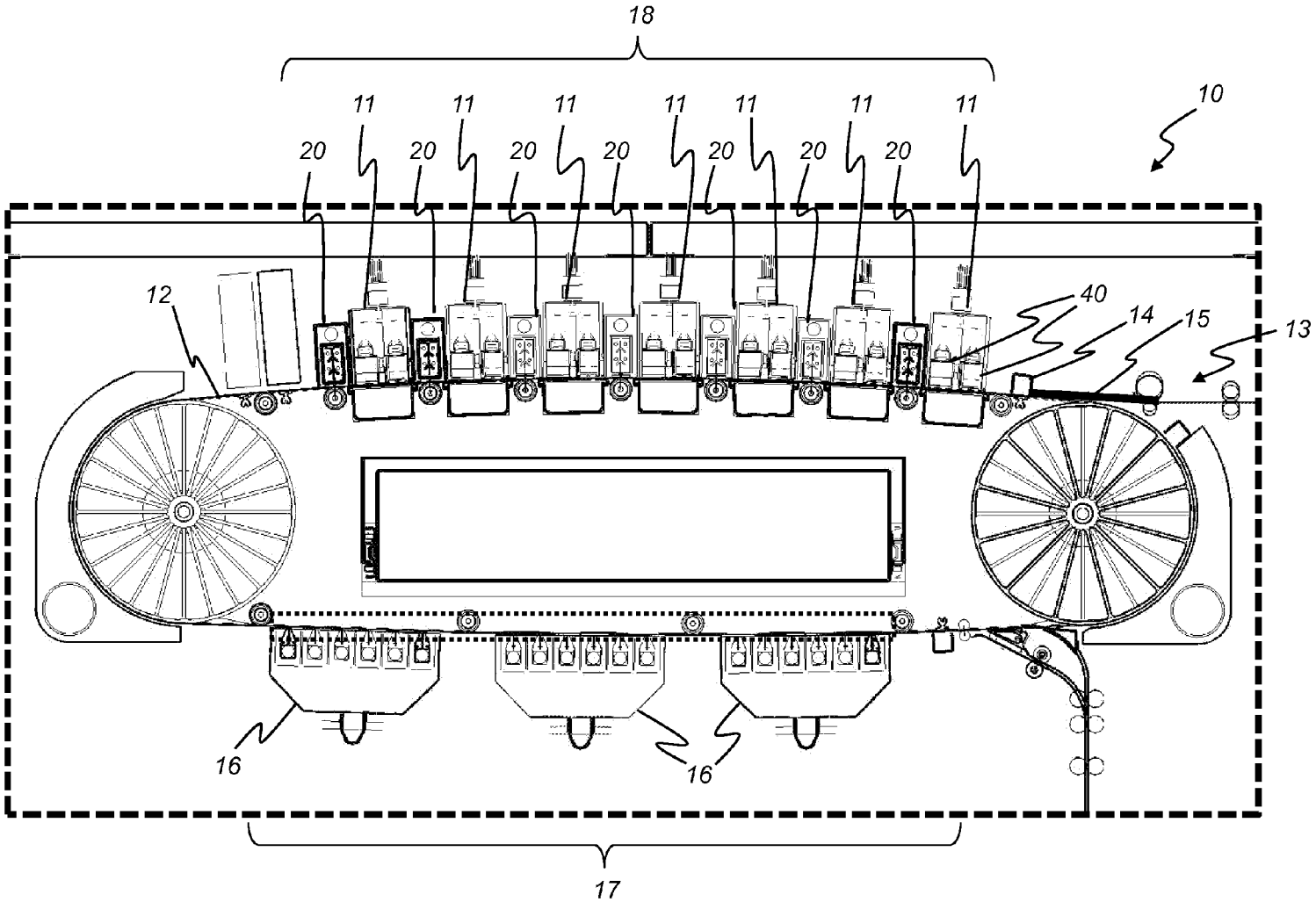
FIG. 1 is a cross-sectional, schematic view of a sheet-fed inkjet marking engine.

FIG. 1 shows a sheet-fed inkjet printer 10 including seven inkjet printhead modules 11 arranged in an ink printing zone 18, wherein each inkjet printhead module 11 contains two inkjet printheads 40, each having an array of ink nozzles for printing drops of ink onto an ink receiver medium 15. Acoustic air impingement dryers 20 are positioned downstream of each inkjet printhead module 11 to accelerate the rate of drying of the wetted ink receiver medium 15. Sheets of ink receiver media 15 are fed into contact with transport web 12 by sheet feed device 13, and the sheets of ink receiver media 15 are electrostatically tacked down to the transport web 12 by corona discharge from a tackdown charger 14. Transport web 12, which is rotating in a counterclockwise direction in this example, then transports the sheets of ink receiver media 15 through the ink printing zone 18 such that a multi-color image is formed on the ink receiver medium 15. The inkjet printheads 40 would typically print inks that contain dye or pigment of the subtractive primary colors cyan, magenta, yellow, and black and produce typical optical densities such that the image would have a transmission density in the primarily absorbed light color, as measured using a device such as an X-Rite Densitometer with Status A filters of between 0.6 and 1.0.

Acoustic air impingement dryers 20 are placed immediately downstream of each inkjet printhead module 11 so that image defects are not generated because of a buildup of liquid ink on the receiver sheet to the point that the ink starts to coalesce and bead up on the surface of the receiver. Poor print quality characteristics can occur if too much ink is delivered to an area of the receiver surface such that a large amount of liquid is on the surface. Controlling coalescence by immediate drying rather than relying on media coatings or the control of other media and/or ink properties allows for more latitude in the selection of the ink receiver medium. It is not necessary for the acoustic air impingement dryer to completely dry the ink deposit. It is only necessary for the dryer to remove enough of the liquid to avoid image quality artifacts.

As shown in FIG. 1, after leaving the ink printing zone 18 the ink receiver medium 15 continues to be transported on the transport web 12 to a final drying zone 17 where any of a number of drying technologies could be used to more fully dry the ink deposit. In the example print engine shown in FIG. 1, conventional air impingement dryers 16 are used to provide final drying. After final drying the sheet can be returned to the ink printing zone 18 by transport web 12 for additional printing on the first side in register with the already printed image, the sheet can be removed from the web and delivered as printed product, or the sheet can be sent through a turn-around mechanism (not shown), reintroduced to the transport web 12 at the sheet feed device 13, and printed on the second side.

In order to produce a high speed inkjet printer in a compact configuration, a compact dryer design must be provided so that the dryers can be placed in proximity to the inkjet printhead modules 11. Acoustic air impingement dryers 20 provide a compact design that can sufficiently dry the ink deposits between inkjet printhead modules 11 to prevent the image quality artifacts associated with ink coalescence.

Figure 2:
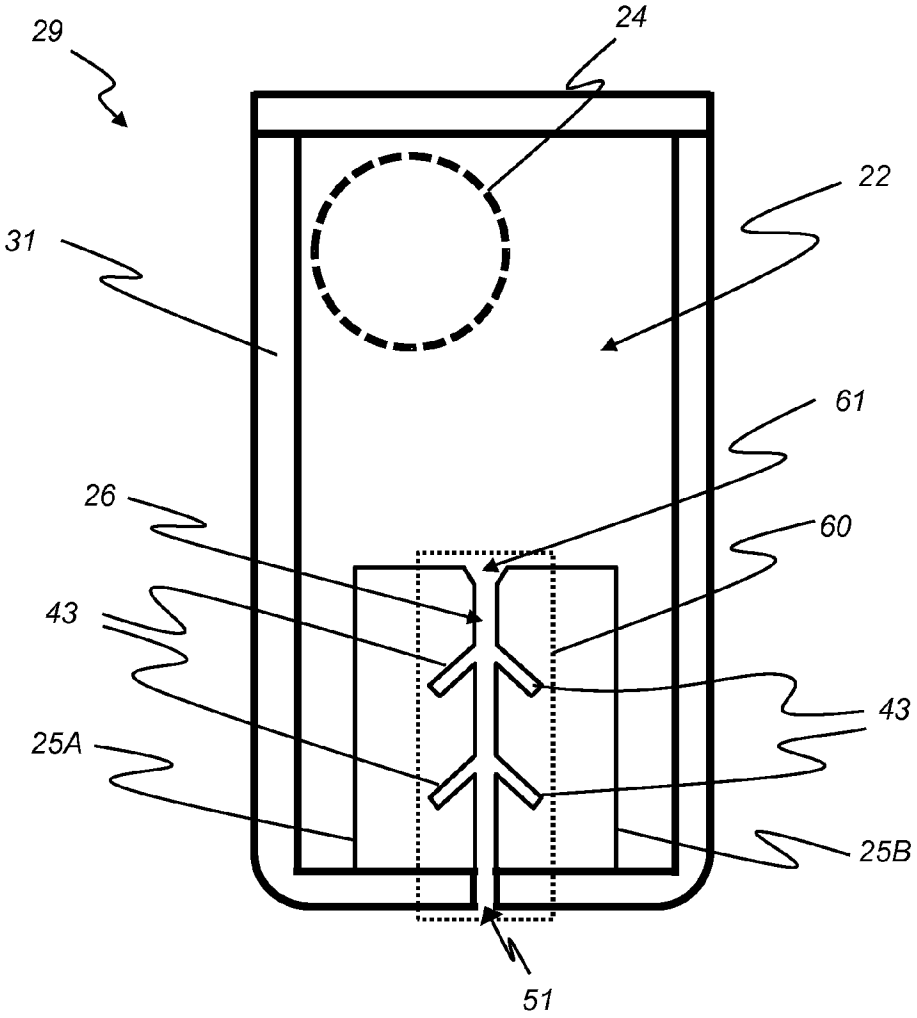
FIG. 2 is a cross-sectional view of a pneumatic acoustic generator module having secondary closed-end resonant chambers according to one embodiment of the invention.

FIG. 2 is a transverse cross-sectional drawing of an exemplary embodiment of a pneumatic acoustic generator module 29 that can be incorporated into an acoustic air impingement dryer 20 (FIG. 1). Heated air is supplied to a supply air chamber 22 enclosed within a supply air chamber enclosure 31 via supply air duct 24 and enters acoustic resonant chamber 60 by passing through main air channel inlet slot 61. (Within the context of the present invention, "air" is any substance in a gaseous state and is not limited to the composition of gases found in the natural atmosphere.) The air can be heated using any heating means known in the art. The heat is generally provided by a heat source such as an electrical heating element (e.g., a coiled nichrome wire).

The acoustic resonant chamber 60 comprises the air channels outlined by the dotted rectangle in the figure, and includes the main air channel inlet slot 61, a main air channel 26, a main air channel exit slot 51, and secondary closed-end resonant chambers 43. The main air channel 26 is the space formed between two pneumatic acoustic generator halves 25A and 25B. The secondary closed-end resonant chambers 43 are cavities formed in the two pneumatic acoustic generator halves 25A and 25B.

As an air stream enters the acoustic resonant chamber 60 through the main air channel inlet slot 61 and flows through the main air channel 26 standing acoustic waves are generated in the secondary closed-end resonant chambers 43. The standing acoustic waves in each secondary closed-end resonant chamber 43 combine to generate high acoustic energy levels (i.e., sound levels) in the air flowing through the main air channel 26. In a preferred embodiment, the pneumatic acoustic generator module 29 is "passive" in the sense that acoustic energy is imparted to the transiting air stream without any active source of pressure modulation. This is analogous to the way that a whistle, a flute or a pipe organ generates acoustic energy. In other embodiments, an active source of pressure modulation (e.g., a diaphragm vibrated by a piezoelectric transducer) can be used in combination with the acoustic resonant chamber 60. The active source can be used to stimulate resonance at a specific frequency.

The airflow that exits through the main air channel exit slot 51 and impinges on the ink and ink receiver medium 15 (FIG. 1) accelerates drying by providing heat, a means of removing evaporated solvent (water), and disruption of the boundary layer formed at the liquid-to-gas phase interface. This boundary layer disruption is provided by the high levels of acoustic pressure in the air stream.

Figure 3:
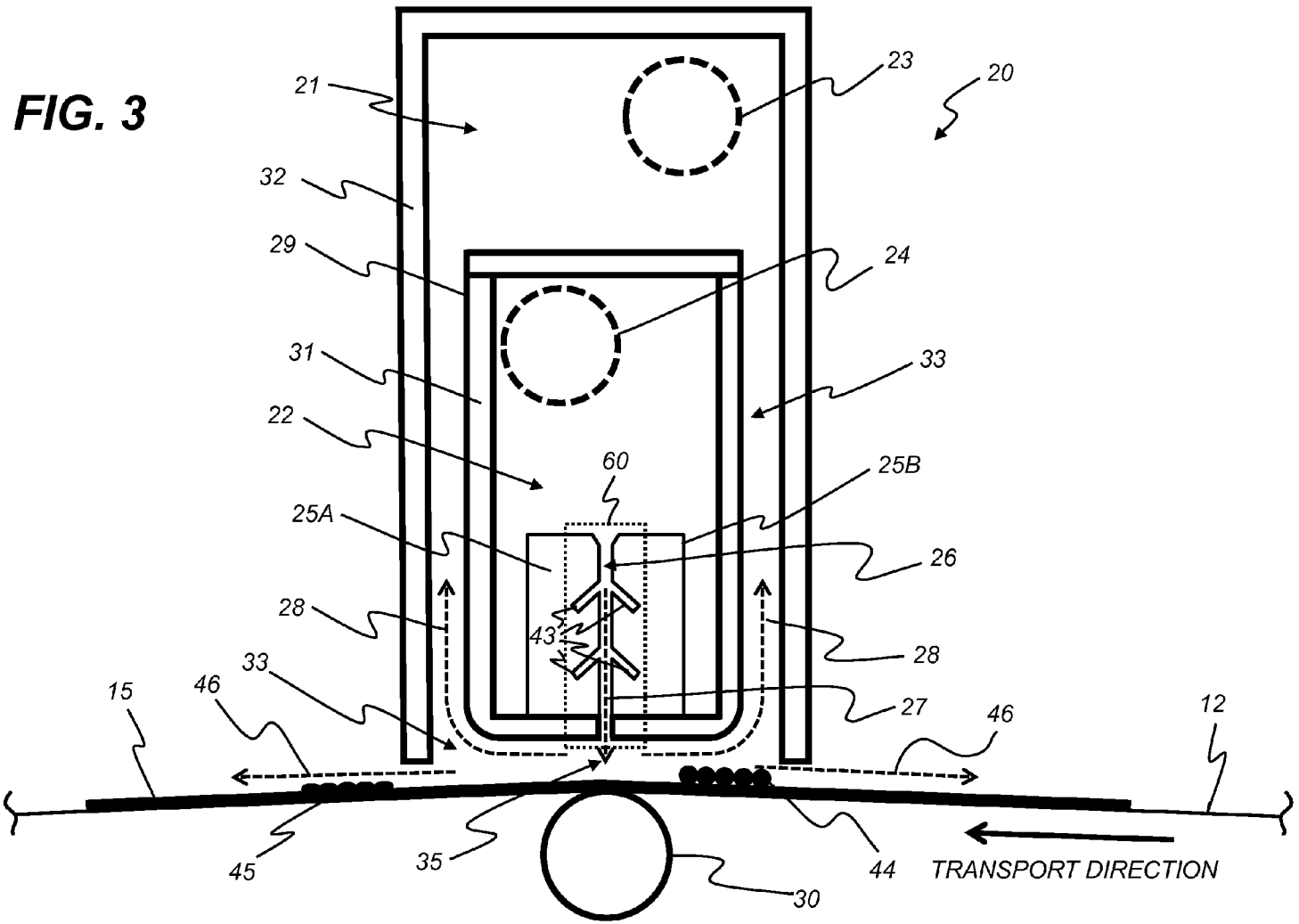
FIG. 3 is a cross-sectional view of an acoustic air impingement dryer including a pneumatic acoustic generator module according to an embodiment of the invention.

A transverse cross sectional drawing of an exemplary embodiment of an acoustic air impingement dryer 20 including a pneumatic acoustic generator module 29 is shown in FIG. 3. Air, which may be heated, is supplied to the pneumatic acoustic generator module 29 via supply air duct 24 into supply air chamber 22 enclosed by supply air chamber enclosure 31, and exits the pneumatic acoustic generator module 29 through the main air channel 26 as impingement air stream 27. The main air channel 26 is formed between the pneumatic acoustic generator halves 25A and 25B. Secondary closed-end resonant chambers 43 are formed into the pneumatic acoustic generator halves 25A and 25B and function to generate the acoustic energy that is imparted to the impingement air stream 27 as it passes through the main air channel 26.

The impingement air stream 27 exits the acoustic air impingement dryer 20 through the main air channel 26 and strikes the sheet of ink receiver medium 15 being transported by transport web 12 in an air impingement drying zone 35. The transport web 12 and the ink receiver medium 15 are supported by backup roller 30 in the air impingement drying zone 35. The ink receiver medium 15 has an image-wise ink deposit 44 on its surface supplied by the upstream inkjet printhead modules 11 and is being transported though the ink printing zone 18 (FIG. 1) by the transport web 12. The drying and reduction in water volume provided by impingement air stream 27 is illustrated by the partially-dried ink deposit 45, which is shown exiting the acoustic air impingement dryer 20 on the downstream side.

After striking the ink receiver medium 15 and ink deposit 44, the impingement air stream 27 contains water vapor as a result of the partial removal of water during the drying of ink deposit 44. At least some of the impingement air stream 27 follows the path indicated by exhaust air streams 28 through exhaust air channels 33 provided on both sides of the pneumatic acoustic generator module 29 and flows into exhaust air chamber 21 enclosed by exhaust air chamber enclosure 32. The air then exits the acoustic air impingement dryer 20 through exhaust air duct 23. Any of the moisture-laden impingement air stream 27 which does not follow the exhaust air stream 28 path into the exhaust air chamber 21 will escape from the acoustic air impingement dryer 20 as shown by escaping air 46. Preferably, the airflows in the impingement air stream 27 and the exhaust air stream 28 are controlled to minimize the amount of escaping air 46 as described in commonly assigned, co-pending U.S. patent application Ser. No. 13/693,309, entitled: "Acoustic drying system with matched exhaust flow", by Shifley et al., which is incorporated herein by reference.

An important aspect of the acoustic air impingement dryer 20 is that high sound pressure levels are attained in the air impingement drying zone 35 without the need to use excessive air flow velocities in the impingement air stream 27 to generate those sound pressure levels. High sound pressure levels of greater than 120 dB SPL are necessary to accelerate drying, but it is important that the air flow through the main air channel 26 of the pneumatic acoustic generator module 29 is not so high that the impingement air stream 27 disrupts the liquid coating (e.g., ink deposit 44) on the material to be dried (e.g., ink receiver medium 15). Disruption of the coating could lead to undesirable coating defects or image artifacts depending on the end use of the material.

In accordance with the present invention, various dimensions of the acoustic resonant chamber 60 (e.g., the length of the main air channel 26 and the lengths of the secondary closed-end resonant chambers 43) are selected to optimize a ratio between the pressure levels and the air flow velocity attained in the air impingement drying zone 35. Preferably, an acoustic pressure provided at the surface of the ink receiver medium 15 is at least 125 dB-SPL, and the air in the impingement air stream 27 impinges on the surface of the ink receiver medium 15 with an air velocity of no more than 40 m/s. To achieve these attributes, it is desirable that most of the acoustic energy (e.g., greater than 70%) is imparted at a single resonant mode.

Figure 4:
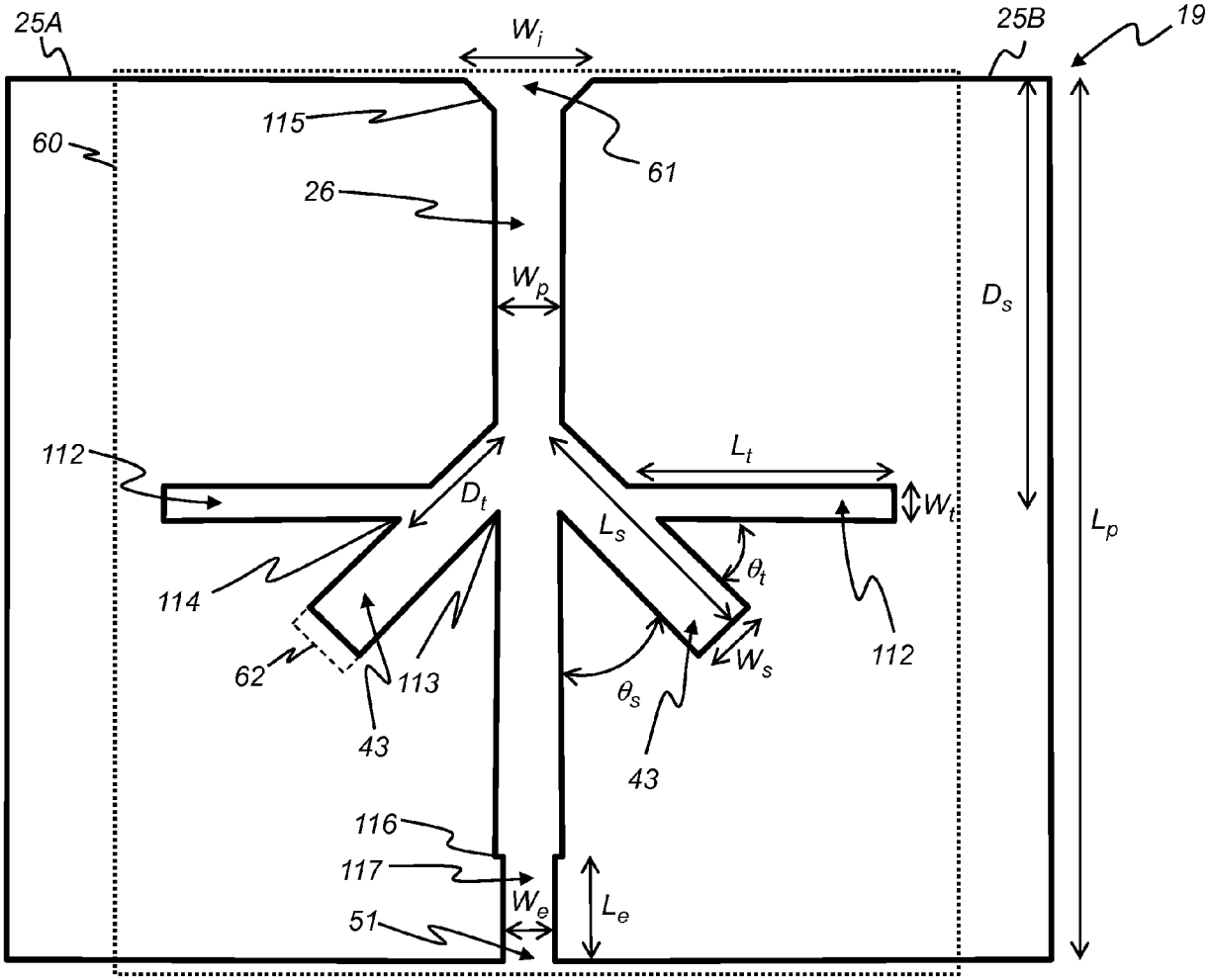
FIG. 4 is a cross-sectional view of a pneumatic acoustic generator having tertiary closed-end resonant chambers according to an alternate embodiment.

FIG. 4 is a cross-sectional drawing of a pneumatic acoustic generator 19 according to an alternate embodiment that has tertiary closed-end resonant chambers 112 in addition to the secondary closed-end resonant chambers 43. In this case, the acoustic resonant chamber 60 includes the main air channel 26, the secondary closed-end resonant chambers 43 (which are formed into a side surface of the main air channel 26) and the tertiary closed-end resonant chambers 112 (which are formed into a side surface of the secondary closed-end resonant chambers 43). Fluid flow models have shown that the addition of these tertiary closed-end resonant chambers 112 can increase the efficiency of the pneumatic acoustic generator and produce high sound pressure levels at relatively low air flow velocities through the main air channel. The exemplary pneumatic acoustic generator 19 shown here has mirror symmetry through the main air channel 26. However, in other embodiments the two pneumatic acoustic generator halves 25A and 25B can be different so that the pneumatic acoustic generator 19 would not have this mirror symmetry.

There are many parameters involved in the design of an efficient pneumatic acoustic generator 19. A set of the most important parameters are shown in FIG. 4. In a preferred embodiment, a fluid flow model is used to adjust some or all of these parameters in order to optimize the performance of the pneumatic acoustic generator 19. A primary air channel width dimension $W_p$ and a primary air channel length dimension $L_p$ are important parameters, as are parameters relating to the exit and entrance geometries of the main air channel 26. The parameters are preferably adjusted to maximize the acoustic energy in a single resonant mode while keeping the airflow in the impingement air stream 27 (FIG. 3) below a level that would disrupt the liquid coating (e.g., ink deposit 44) on the material to be dried (e.g., ink receiver medium 15). In some embodiments, the selection of the various parameters can be done based on empirical experimentation rather than fluid flow modeling.

In the illustrated embodiment, a tapered inlet slot transition 115 is provided at the main air channel inlet slot 61, and an exit air channel 117 is formed by narrowing the main air channel 26 at exit air channel transition 116 to provide a narrower width dimension at main air channel exit slot 51. The parameters that define the exit and entrance geometries of the main air channel 26 are inlet slot width dimension $W_i$, the shape of the inlet slot transition 115, exit slot width dimension $W_e$, exit air channel length dimension $L_e$, and the shape of the exit air channel transition 116.

The position, number and shape of the secondary closed-end resonant chambers 43 and tertiary closed-end resonant chambers 112 are also very important attributes of the system.

Some important parameters that partially define the characteristics of the secondary closed-end resonant chambers 43 are secondary resonant chamber length dimension $L_s$, and secondary resonant chamber width dimension $W_s$. Similarly, some important parameters that partially define the characteristics of the tertiary closed-end resonant chambers 112 are tertiary resonant chamber length dimension $L_t$, and tertiary resonant chamber width dimension $W_t$.

Secondary chamber jet edges 113 and tertiary chamber jet edges 114 are the features in the pneumatic acoustic generator 19 that create the disturbance in the airstream that leads to excitation of resonance in the closed end resonance chambers. An additional set of important parameters define the geometry of these jet edges. The main parameters that define the secondary chamber jet edges 113 are secondary chamber jet edge distance $D_s$ and secondary resonant chamber angle $\theta_s$. Similarly, tertiary chamber jet edge distance $D_t$ and tertiary resonant chamber angle $\theta_t$ are the main parameters that define the geometry of tertiary chamber jet edges 114. The secondary resonant chamber angle $\theta_s$ and the tertiary resonant chamber angle $\theta_t$ are preferably acute angles in the range of 20°-60° (e.g., 45°). In a preferred embodiment, the angles are selected to maximize the amount of acoustic energy imparted in a single resonant mode.

In an alternate embodiment the pneumatic acoustic generator 19 includes an optional active acoustic transducer 62 to provide an active source of pressure modulation. For example, the active acoustic transducer 62 can be a diaphragm vibrated by a piezoelectric transducer. The active acoustic transducer 62 can be used to stimulate resonance at a specific acoustic frequency. The active acoustic transducer 62 can be positioned at various locations within the acoustic resonant chamber 60. In the illustrated embodiment, the active acoustic transducer 62 is positioned at the end of one of the secondary closed-end resonant chambers 43, although it could also be positioned at other locations (e.g., on any end or wall of one of the closed-end resonant chambers, or on a wall of the main air channel 26.)

A fluid flow model was used to adjust the design parameters for the pneumatic acoustic generator 19 of FIG. 4 in order to provide a design having an improved efficiency as characterized by the ratio between the pressure levels and the air flow velocity attained in the air impingement drying zone 35 (FIG. 3). The use of fluid flow models to determine air flow characteristics is well-known to those skilled in the art. The air flow can be modeled by the wave equation for it is inviscid. The frequencies of the whistle can be determined by the eigenvalues of the well-known Helmoltz equation: $\nabla^2 P + k^2 P = 0$ where P is the pressure as a function of position, with the well-known zero Dirichlet boundary condition at the top, no flux boundary conditions on the wall and the well-known Sommerfeld's Radiation condition at the far field. The eigenvalue problem can be solved numerically using a finite element method. In some embodiments, the MATLAB Partial Differential Equation Toolbox can be used to solve the eigenvalues problem. The resonance frequencies of the whistle are $\omega = ck$, where c is the velocity of sound and k are the eigenvalues of the Helmoltz's equation.

To compute the volumetric flow rate, the pressure boundary condition at the top can be set to the prescribed applied pressure. The Helmholtz equation can then be solved with k equal to one of the eigenvalues that were computed previously to determine a pressure distribution. The flow rate U can then be determined using the following equation:

$$U = \frac{S}{ik\rho c}\nabla P \tag{1}$$

where S is the surface area, ρ is the density of the air, and i is $\sqrt{-1}$. From this, the impedance Z(k) can be determined for each eigenvalue along using:

$$Z(k) = \frac{P}{U} \tag{2}$$

The location of the maximum impedance will correspond to the location of a node where the pressure is highest and the flow rate is the lowest. This will correspond to the location where the ink receiver medium 15 should be positioned to provide optimal performance.

One characteristic for pneumatic acoustic generators 19 that have desirable air flow characteristics is that the majority of the acoustic energy is imparted in a single resonant mode. The gap between the ink receiver medium 15 and the main air channel exit slot 51 can then be adjusted so that the ink receiver medium 15 is positioned at a displacement node (i.e., a position where the air displacement is at a minimum) of the single resonant mode. (The displacement node will correspond to a pressure anti-node where the pressure is at a maximum.) In this way, the pressure will be maximized while the amplitude of the air displacement will be minimized. In some cases, the gap between the ink receiver medium 15 and the main air channel exit slot 51 can be adjusted in real time to account for any drift of the node position as operating conditions for the pneumatic acoustic generator 19 change with time. Examples of operating conditions that can change with time would include changes in air temperature or air flow rate in the impingement air stream 27, and changes in dimensions of the pneumatic acoustic generators 19 due to temperature changes during device operation. For example, a microphone system can be used to sense the acoustic frequency generated by the pneumatic acoustic generator 19. An optimal air gap can then be determined corresponding to a node position for the measured acoustic frequency. The air gap can then be controlled accordingly by adjusting the position of the acoustic air impingement dryer 20 (FIG. 3) or by adjusting the position of the material (e.g., by adjusting the position of the backup roller 30).

Figure 5:
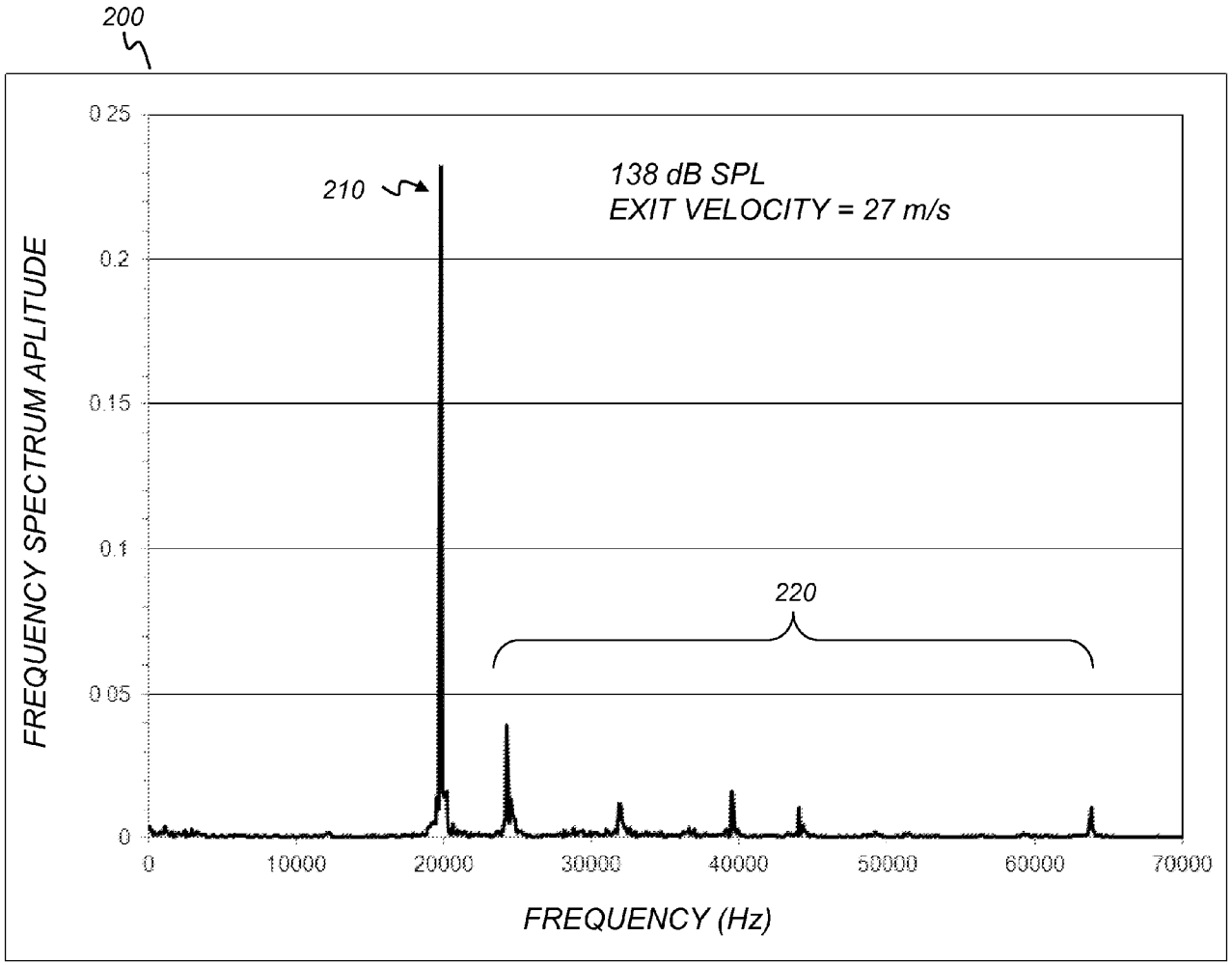
FIG. 5 is a power spectrum for the acoustic energy imparted by an exemplary pneumatic acoustic generator design.

A set of design parameters for an exemplary pneumatic acoustic generator 19 determined in this manner is shown in Table 1. The fluid flow model indicates that this design for a pneumatic acoustic generator 19 is able to produce sound pressure levels of 140 dB SPL with an impingement air exit velocity of 27 m/s. (The impingement air exit velocity of 27 meters per second is low enough that coating disruption will not occur). FIG. 5 shows a measured power spectrum 200 for the acoustic energy provided by this design when operated at an exit velocity of 27 m/s. It can be seen that the majority of the acoustic energy is imparted in a main resonant mode 210, while a small amount of the acoustic energy is imparted in other resonant modes 220. Preferably, at least 70% of the energy is imparted in a single resonant mode. (In this example 72% of the acoustic energy is imparted in the main resonant mode 210.)

TABLE 1

| Exemplary design parameters. | |
|---|---|
| primary air channel length dimension, $L_p$ | 13.24 mm |
| secondary resonant chamber length dimension, $L_s$ | 4.14 mm |
| tertiary resonant chamber length dimension, $L_t$ | 4.00 mm |
| exit air channel length dimension, $L_e$ | 1.50 mm |
| primary air channel width dimension, $W_p$ | 1.00 mm |
| secondary resonant chamber width dimension, $W_s$ | 1.12 mm |
| tertiary resonant chamber width dimension, $W_t$ | 0.50 mm |
| inlet slot width dimension, $W_i$ | 2.00 mm |
| exit slot width dimension, $W_e$ | 0.40 mm |
| secondary chamber jet edge distance, $D_s$ | 5.64 mm |
| tertiary chamber jet edge distance, $D_t$ | 2.12 mm |
| secondary resonant chamber angle, $\theta_s$ | 45° |
| tertiary resonant chamber angle, $\theta_t$ | 45° |

Figure 6:
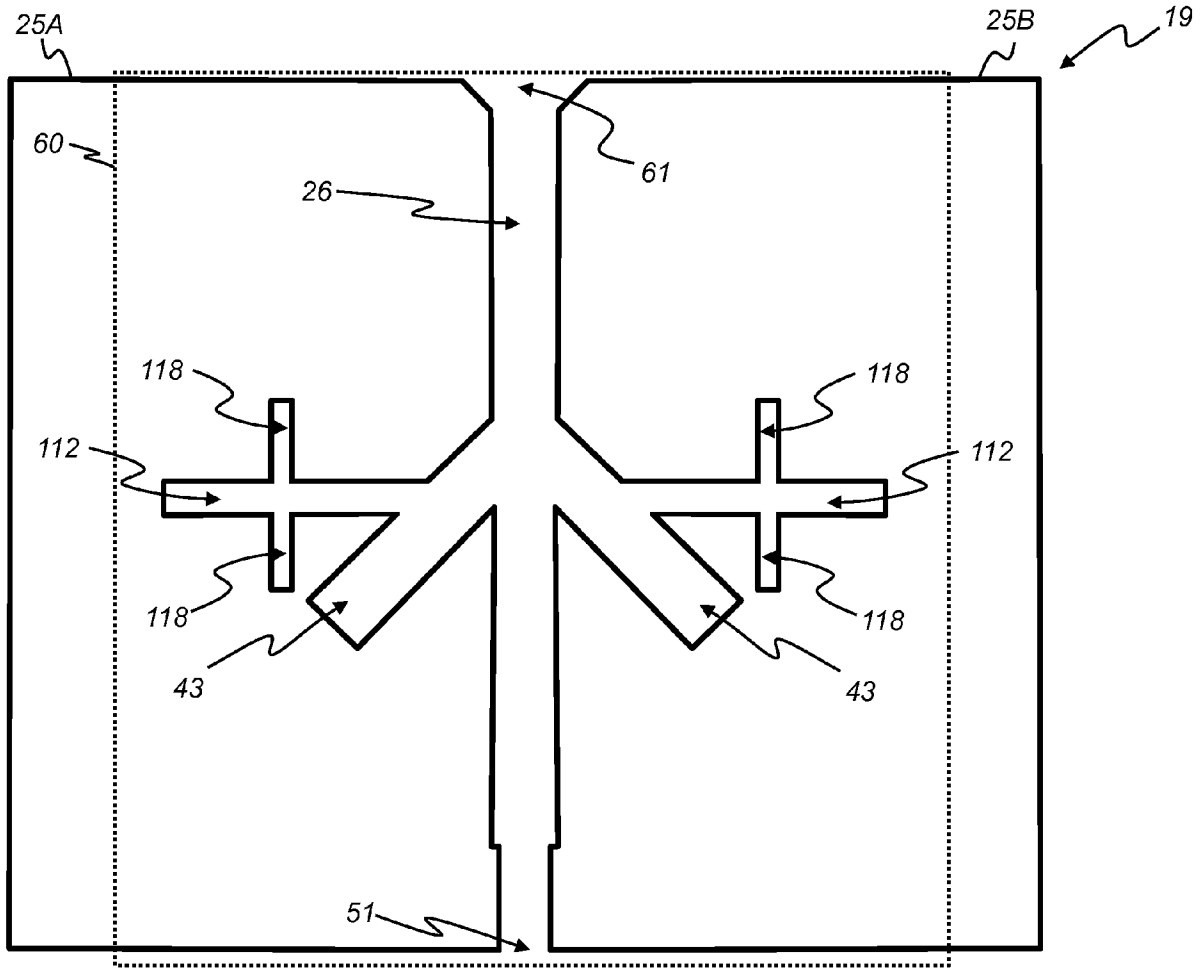
FIG. 6 is a cross-sectional view of a pneumatic acoustic generator having quaternary closed-end resonant chambers according to an alternate embodiment.

It will be obvious to those skilled in the art that this basic approach can be extended in a straightforward manner to include higher-order resonant chambers. For example, FIG. 6 shows an example of a pneumatic acoustic generator 19 having an acoustic resonant chamber 60 with a main air channel 26 (having main air channel inlet slot 61 and main air channel exit slot 51), secondary closed-end resonant chambers 43 and tertiary closed-end resonant chamber 112, and additionally includes quaternary closed-end resonant chambers 118 formed into side surfaces of the tertiary closed-end resonant chamber 112. The use of the higher-order resonant chambers provides for additional degrees of freedom that can be used to further optimize the performance of the pneumatic acoustic generator 19. Generally, as the number of orders of resonant chambers is increase, the percentage of acoustic energy imparted in the single resonant mode can also be increased at the expense of a design that is more complex to fabricate.

Figure 7:
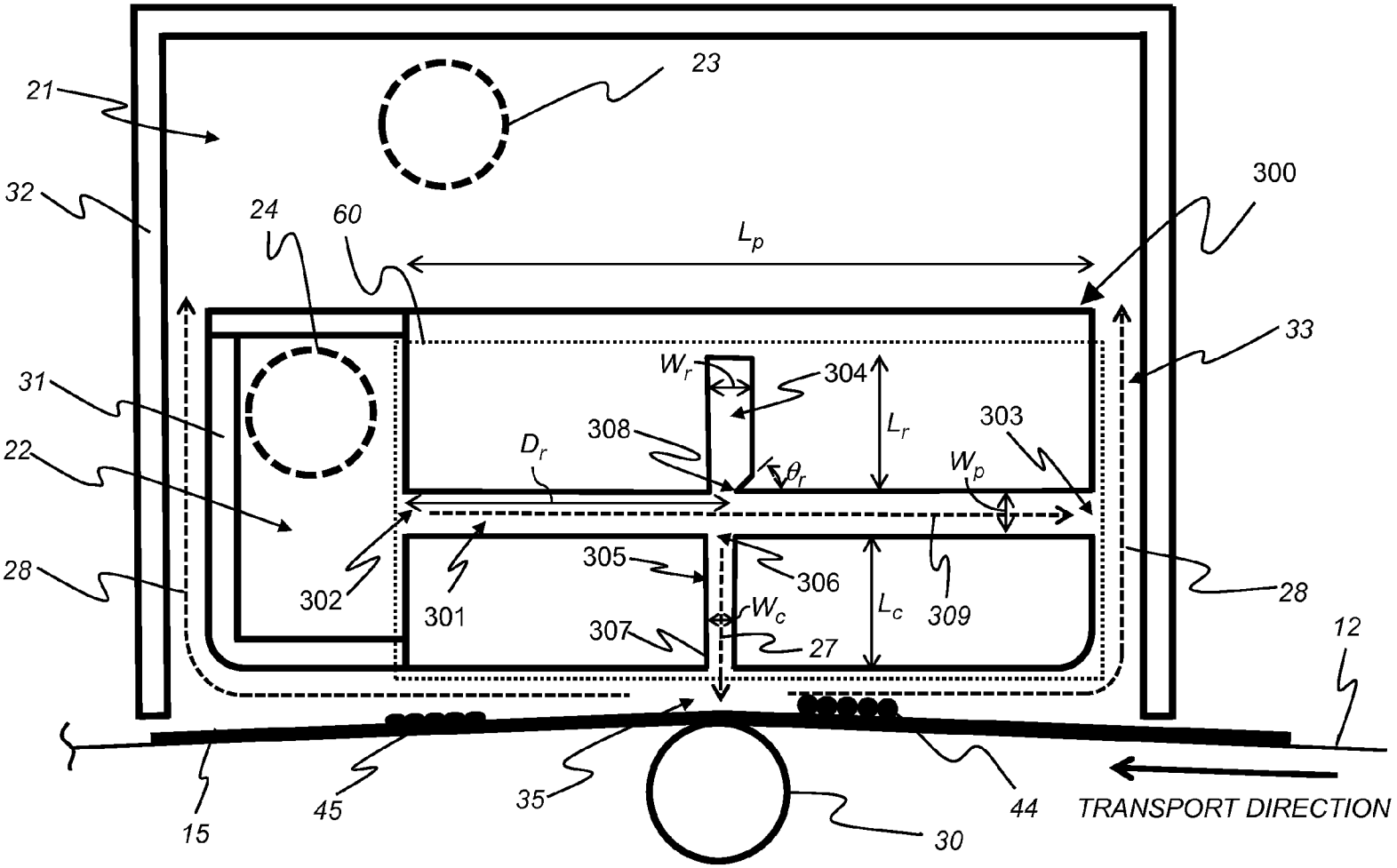
FIG. 7 is a cross-sectional view of a pneumatic acoustic generator having a primary air channel and a sound air channel according to an alternate embodiment.

FIG. 7 is a cross-sectional view of a pneumatic acoustic generator 300 according to an alternate embodiment that provides a reduced air flow in the impingement air stream 27, while maintaining a high level of acoustic energy. In the illustrated embodiment, the pneumatic acoustic generator 300 is used to dry ink deposit 44 on ink receiver medium 15. Transport web 12, ink receiver medium 15, exhaust air chamber 21, supply air chamber 22, exhaust air duct 23, supply air duct 24, exhaust air stream 28, backup roller 30, supply air chamber enclosure 31, exhaust air chamber enclosure 32, exhaust air channel 33, air impingement drying zone 35, ink deposit 44, and partially-dried ink deposit 45 are analogous to the corresponding components in FIG. 3.

The pneumatic acoustic generator 300 includes acoustic resonant chamber 60 having a primary air channel 301 with a primary air channel inlet 302 and a primary air channel outlet 303. The primary air channel 301 has a primary air channel length dimension $L_p$ and a primary air channel width dimension $W_p$. The acoustic resonant chamber 60 also includes a closed-end resonant chamber 304 formed into a first side surface of the primary air channel 301, and a sound air channel 305. The sound air channel 305 has a sound air channel inlet 306 formed into a second side surface of the primary air channel 301 opposite to the closed-end resonant chamber 304, and a sound air channel outlet 307 for directing the impingement air stream 27 onto a material (e.g., transport web 12). The closed-end resonant chamber 304 has a resonant chamber length dimension $L_r$ and a resonant chamber width dimension $W_r$. The sound air channel 305 has a sound air channel length dimension $L_c$ and a sound air channel width dimension $W_e$.

During operation of the pneumatic acoustic generator 300, air is supplied to the primary air channel inlet 302 from the supply air chamber 22. Air flows through the primary air channel 301 as primary air stream 309. A fraction of the transiting air in the primary air stream 309 exits the acoustic resonant chamber 60 through the sound air channel 305 thereby forming the impingement air stream 27. The transiting airflow through the acoustic resonant chamber 60 excites an acoustic resonance in the closed-end resonant chamber 304 in a manner similar to a musician blowing across the mouthpiece of a flute. A jet edge 308 is optionally provided to more efficiently excite the acoustic resonance. The jet edge 308 is positioned at a resonant chamber jet edge distance $D_r$ relative to the primary air channel inlet 302. Generally, the jet edge 308 is an angular feature having an acute resonant chamber jet edge angle $\theta_r$ (e.g., in the range of 20°-60°).

A majority of the transiting air (i.e., more than 50%) exits the pneumatic acoustic generator 300 through the primary air channel outlet 303, while a smaller fraction of the air exits through the sound air channel outlet 307. A high air velocity can be provided in the primary air stream 309 in order to efficiently excite a high amplitude of acoustic energy, while not creating an excessive air velocity in the impingement air stream 27 that could disturb the ink deposit 44 on the ink receiver medium 15. A large fraction of the acoustic energy is directed from the closed-end resonant chamber 304 into the sound air channel 305, so that the impingement air stream 27 has a high-level of acoustic energy, thereby increasing the drying efficiency. The impingement air stream 27 should have at least a minimum airflow rate needed to remove the evaporated moisture from the air impingement drying zone 35, while not exceeding a maximum airflow rate that would disrupt the liquid coating (e.g., ink deposit 44) on the material to be dried (e.g., ink receiver medium 15). Disruption of the coating could lead to undesirable coating defects or image artifacts depending on the end use of the material. This configuration can provide a higher level of acoustic energy for a given airflow in the impingement air stream 27 than embodiments such as that shown in FIG. 3. The various dimensions and angles associated with the primary air channel 301, the closed-end resonant chamber 304, the sound air channel 305 and the jet edge 308 are preferably selected to maximize the amount of acoustic energy in a single resonant mode while keeping the airflow rate in the impingement air stream 27 less than the appropriate maximum airflow rate. The selection of the dimensions and angles can be done by using a fluid flow model to model air flow characteristics for the pneumatic acoustic generator 300 as discussed above, or can be done based on empirical experimentation. In a preferred embodiment, the dimensions and angles and selected so that the acoustic pressure provided at the surface of the material is at least 135 dB-SPL while the air velocity in the impingement air stream 27 is no more than 40 m. Preferably, more than 80% of the acoustic energy is imparted in a single main resonant mode It will be obvious to one skilled in the art that the various features discussed earlier with respect to the embodiments of FIGS. 2-6 can optionally be incorporated into this configuration in order to provide advantageous effects. For example, secondary closed-end resonant chambers 43, tertiary closed-end resonant chambers 112 and quaternary closed-end resonant chambers 118 can be incorporated into the closed-end resonant chamber 304 in order to increase the percentage of the acoustic energy that is imparted in the main resonant mode. Similarly, an active acoustic transducer 62 can be used to stimulate resonance at a specific acoustic frequency.

While the embodiments of the acoustic air impingement dryer 20 were described within the context of drying a printed image in inkjet printer 10, it will be obvious to one skilled in the art, that it can alternatively be used in other drying applications where liquid coatings are applied to the surface of a medium, and where it is necessary to remove a volatile portion of the liquid coating by some drying process. For example, the acoustic air impingement dryer 20 can be used in a web coating system in the production of photographic films or thermal imaging donor materials.

The invention has been described in detail with particular reference to certain preferred embodiments thereof, but it will be understood that variations and modifications can be effected within the spirit and scope of the invention.

PARTS LIST

10 inkjet printer
11 inkjet printhead module
12 transport web
13 sheet feed device
14 tackdown charger
15 ink receiver medium
16 air impingement dryer
17 final drying zone
18 ink printing zone
19 pneumatic acoustic generator
20 acoustic air impingement dryer
21 exhaust air chamber
22 supply air chamber
23 exhaust air duct
24 supply air duct
25A pneumatic acoustic generator half
25B pneumatic acoustic generator half
26 main air channel
27 impingement air stream
28 exhaust air stream
29 pneumatic acoustic generator module
30 backup roller
31 supply air chamber enclosure
32 exhaust air chamber enclosure
33 exhaust air channel
35 air impingement drying zone
40 inkjet printhead
43 secondary closed-end resonant chambers
44 ink deposit
45 partially-dried ink deposit
46 escaping air
51 main air channel exit slot
60 acoustic resonant chamber
61 main air channel inlet slot
62 active acoustic transducer
112 tertiary closed-end resonant chamber
113 secondary chamber jet edge
114 tertiary chamber jet edge
115 inlet slot transition
116 exit air channel transition
117 exit air channel
118 quaternary closed-end resonant chamber
200 power spectrum
210 main resonant mode
220 other resonant modes
300 pneumatic acoustic generator
301 primary air channel
302 primary air channel inlet
303 primary air channel outlet
304 closed-end resonant chamber
305 sound air channel
306 sound air channel inlet
307 sound air channel outlet
308 jet edge
309 primary air stream
$D_r$ resonant chamber jet edge distance
$D_s$ secondary chamber jet edge distance
$D_t$ tertiary chamber jet edge distance
$L_c$ sound air channel length dimension
$L_e$ exit air channel length dimension
$L_p$ primary air channel length dimension
$L_r$ resonant chamber length dimension
$L_s$ secondary resonant chamber length dimension
$L_t$ tertiary resonant chamber length dimension
$W_c$ sound air channel width dimension
$W_e$ exit slot width dimension
$W_i$ inlet slot width dimension
$W_p$ primary air channel width dimension
$W_r$ resonant chamber width dimension
$W_s$ secondary resonant chamber width dimension
$W_t$ tertiary resonant chamber width dimension
$\theta_r$ resonant chamber jet edge angle
$\theta_s$ secondary resonant chamber angle
$\theta_t$ tertiary resonant chamber angle

The invention claimed is:

1. An acoustic wave drying system for drying a material, comprising:
an airflow source;
an acoustic resonant chamber that directs acoustic energy onto the material, including:
an air inlet for receiving air from the airflow source;
an air outlet;
a primary air channel having side surfaces connecting the air inlet and the air outlet, the primary air channel having a primary air channel length between the air inlet and the air outlet;
a closed-end resonant chamber formed into a first side surface of the primary air channel, the closed-end resonant chamber having side surfaces and a resonant chamber length; and
a sound air channel having a sound air channel inlet on a second side surface of the primary air channel opposite to the closed-end resonant chamber and a sound air channel outlet for directing an air impingement airstream containing acoustic energy onto the material, the material being spaced apart from the sound air channel outlet by a gap distance, the sound air channel having a sound air channel length between the sound air channel inlet and the sound air channel outlet;
wherein a first fraction of the air received from the airflow source is directed out of the pneumatic transducer through the air outlet and a second fraction of the air received from the airflow source is directed out of the pneumatic transducer through the sound air channel outlet as the air impingement airstream.

2. The acoustic wave drying system of claim 1 wherein the second fraction is no more than 50%.

3. The acoustic wave drying system of claim 1 wherein the resonant chamber length and the sound air channel length are selected such that the acoustic energy in the air impingement airstream provides an acoustic pressure at a surface of the material of at least 125 dB-SPL, and the air impingement airstream impinges on the surface of the material with an air velocity of no more than 40 m/s.

4. The acoustic wave drying system of claim 1 wherein the primary air channel length, the resonant chamber length and the sound air channel length are selected such that more than 70% of the acoustic energy is imparted in a single main resonant mode.

5. The acoustic wave drying system of claim 1 further including one or more secondary closed-end resonant chambers formed into a side surface of the closed-end resonant chamber, the secondary closed-end resonant chambers having secondary resonant chamber lengths.

6. The acoustic wave drying system of claim 5 further including one or more tertiary closed-end resonant chambers formed into a side surface of the secondary closed-end resonant chambers, the tertiary closed-end resonant chambers having tertiary resonant chamber lengths.

7. The acoustic wave drying system of claim 1 wherein the gap distance is adjusted to position the material substantially at a displacement node of a main resonant mode.

8. The acoustic wave drying system of claim 1 wherein a jet edge having an acute jet edge angle is formed where the closed-end resonant chamber joins with the primary air channel.

9. The acoustic wave drying system of claim 8 wherein the jet edge angle is selected to maximize the amount of acoustic energy imparted in a main resonant mode.

10. The acoustic wave drying system of claim 1 wherein the acoustic energy is generated passively by the movement of the transiting air through the acoustic resonant chamber.

11. The acoustic wave drying system of claim 1 further including an active acoustic transducer positioned within the acoustic resonant chamber controlled to stimulate resonance at a specified acoustic frequency.

12. The acoustic wave drying system of claim 1 wherein the material is an ink receiver medium having an image-wise ink deposit or a web medium coated with a liquid coating.

13. The acoustic wave drying system of claim 1 wherein the air provided airflow source is heated using a heat source.

* * * * *